US010381180B1

(12) United States Patent
Ferree

(10) Patent No.: US 10,381,180 B1
(45) Date of Patent: Aug. 13, 2019

(54) ELECTRIC ARC EXTINGUISHING APPARATUS FOR A MOLDED CASE CIRCUIT BREAKER

(71) Applicant: Siemens Industry, Inc., Alpharetta, GA (US)

(72) Inventor: James Edward Ferree, Lawrenceville, GA (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 0 days.

(21) Appl. No.: 16/103,325

(22) Filed: Aug. 14, 2018

(51) Int. Cl.

| | |
|---|---|
| ***H01H 33/74*** | (2006.01) |
| ***H01H 33/10*** | (2006.01) |
| ***H01H 71/02*** | (2006.01) |
| *H01H 33/02* | (2006.01) |

(52) U.S. Cl.
CPC ..... *H01H 33/74* (2013.01); *H01H 33/10* (2013.01); *H01H 71/0207* (2013.01); *H01H 33/022* (2013.01)

(58) Field of Classification Search
None
See application file for complete search history.

(56) References Cited

U.S. PATENT DOCUMENTS

| | | | | |
|---|---|---|---|---|
| 4,375,021 | A * | 2/1983 | Pardini | H01H 9/36 218/25 |
| 5,153,545 | A | 10/1992 | Ferullo et al. | |
| 5,689,097 | A * | 11/1997 | Aufermann | H02B 1/565 218/157 |
| 6,198,063 | B1 | 3/2001 | Kramer | |
| 6,248,970 | B1 | 6/2001 | DiMarco et al. | |
| 8,164,018 | B2 | 4/2012 | Yang | |
| 2006/0213873 | A1* | 9/2006 | Shea | H01H 9/342 218/34 |
| 2008/0074217 | A1* | 3/2008 | Duchrow | H01H 9/342 335/202 |
| 2011/0174781 | A1* | 7/2011 | Zhou | H01H 9/302 218/157 |
| 2011/0192822 | A1* | 8/2011 | Malingowski | H01H 9/342 218/157 |
| 2013/0021711 | A1* | 1/2013 | Gao | H01H 9/302 361/115 |
| 2015/0348720 | A1* | 12/2015 | Smeltzer | H01H 9/34 218/151 |
| 2017/0309425 | A1 | 10/2017 | Rival et al. | |

* cited by examiner

*Primary Examiner* — Truc T Nguyen

(57) ABSTRACT

An electric arc extinguishing apparatus for a molded case circuit breaker is provided. A first set of arc splitter plates (30) directs into a first flow channel (32) a flow of gases formed during an arcing event. A second set of arc splitter plates (40) directs into a second flow channel (42) a further flow of gases formed during the arcing event. A baffle (46) establishes flow channel separation between the first and second flow channels. This arrangement provides gas flow velocity that is relatively uniform throughout the arc stack and efficiently and reliably removes heat from the hot gas flow since every arc splitter plate effectively contributes to the cooling of the gas flow. Additionally, the electric arc is efficiently blown and distributed into each of the arc splitter plate gaps, resulting in higher arc voltage and improved arc extinguishing performance.

20 Claims, 6 Drawing Sheets

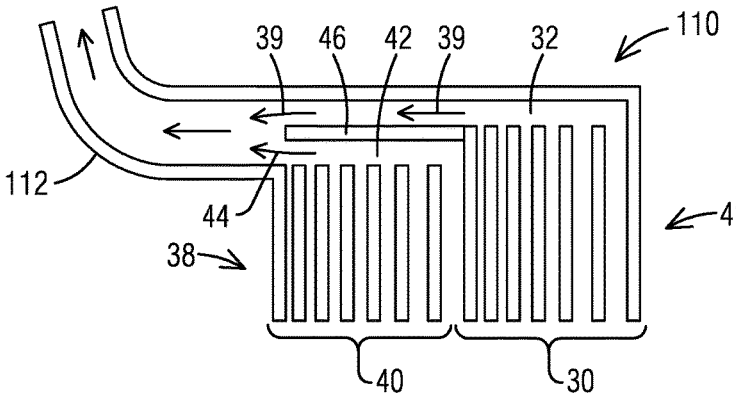
FIG. 10
FIG. 11
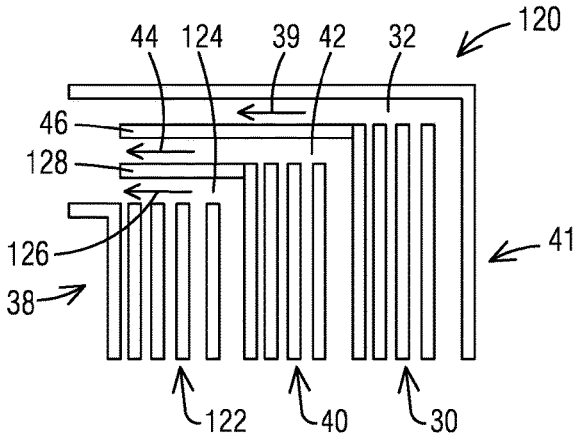
FIG. 12
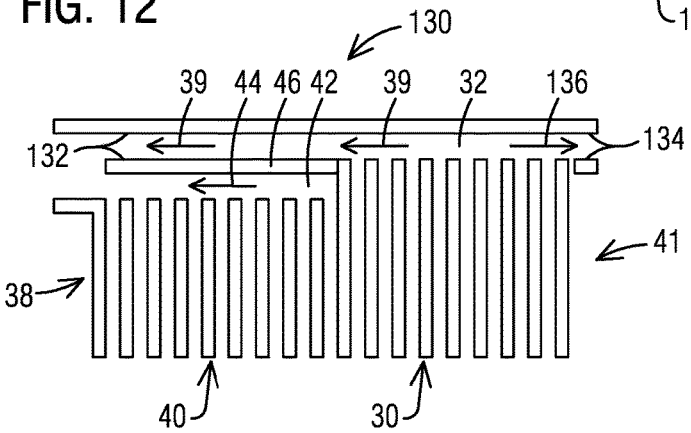
FIG. 13
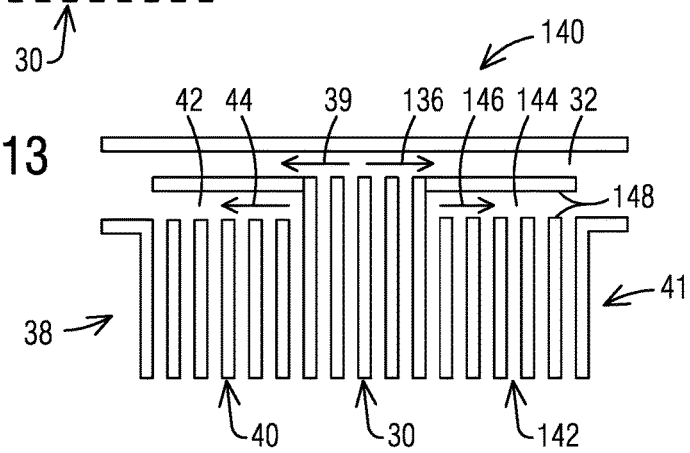

ELECTRIC ARC EXTINGUISHING APPARATUS FOR A MOLDED CASE CIRCUIT BREAKER

BACKGROUND

1. Field

The present invention relates generally to the field of circuit breakers, and, more particularly, to an electric arc extinguishing apparatus for a molded case circuit breaker.

2. Description of the Related Art

In general, a circuit breaker operates to engage and disengage a protected electric load from a power source. The circuit breaker ensures appropriate current interruption thereby providing protection to the electric load from continuous overcurrent conditions and high current transients due, for example, to electrical short circuits. Typically, the circuit breaker operates by separating a pair of electrical contacts contained within a housing of the circuit breaker. For example, one electrical contact is stationary while the other is movable (e.g., mounted on a pivotable contact arm). The contact separation may occur manually, such as by a person moving a throw handle of the circuit breaker. This may engage a trip mechanism, which may be coupled to the contact arm and moveable contact. Otherwise, the electrical contacts may be separated automatically when an overcurrent or short circuit condition is encountered. This automatic tripping may be accomplished by an operating or tripping mechanism actuated via a thermal overload element (e.g., a bimetal element) or by an electromagnetic element (e.g., an actuator).

Upon separation of the electrical contacts by tripping of the circuit breaker, an electrical arc may be formed. It is desirable to extinguish such an arc as quickly as possible to avoid damaging internal components of the circuit breaker and to minimize exposure of nearby components due to damaging let-through currents. Use of an arc stack with metallic arc splitter plates is known. See U.S. Pat. No. 6,248,970 for one example of a molded case circuit breaker involving such arc stack.

BRIEF DESCRIPTION

One disclosed embodiment is directed to an electric arc extinguishing apparatus for a molded case circuit breaker. A first set of arc splitter plates may be arranged to direct into a first flow channel a flow of gases formed during an electric arcing event. An outer boundary of the first flow channel may be defined by a wall of a casing of the molded case circuit breaker. The wall may be disposed to redirect at least one portion of the flow of gases directed by the first set of arc splitter plates toward a first side of the molded case circuit breaker. A second set of arc splitter plates may be arranged to direct into a second flow channel a further flow of gases formed during the electric arcing event. A baffle may be arranged to establish flow channel separation between the first flow channel and the second flow channel. A boundary of the second flow channel is defined by an inner surface of a wall of the baffle. The inner surface of the wall of the baffle may be arranged to redirect the further flow of gases directed by the second set of arc splitter plates toward the first side of the molded case circuit breaker.

A further disclosed embodiment is directed to a molded case circuit breaker including a non-metallic molded case, first and second terminals, first and second contacts respectively coupled to the first and second terminals, an operating mechanism contained within said non-metallic molded case and coupled to a respective one of the first and second contacts to cause the respective contact to disengage the other of the contacts in response to an overcurrent condition in a protected electric load, and an arc stack. The arc stack may include a first set of arc splitter plates and a second set of arc splitter plates forming a sequential arrangement of spaced apart arc splitter plates to cool and deionize an electric arc formed between the contacts when the contacts are separated in response to the overcurrent condition. The first set of arc splitter plates may be arranged to direct into a first flow channel a flow of gases resulting from occurrence of the electric arc. An outer boundary of the first flow channel may be defined by a wall of the non-metallic molded case of the circuit breaker. The wall may be disposed to redirect at least one portion of the flow of gases directed by the first set of arc splitter plates toward a first side of the non-metallic molded case of the circuit breaker. A second set of arc splitter plates may be arranged to direct into a second flow channel a further flow of gases resulting from the occurrence of the electric arc. A non-metallic partition structure, such as a baffle, may be arranged to establish flow channel separation between the first flow channel and the second flow channel. A boundary of the second flow channel may be defined by an inner surface of a wall of the non-metallic partition structure. The inner surface of the wall of the non-metallic partition structure may be arranged to redirect another portion of the flow of gases directed by the second set of arc splitter plates toward the first side of the non-metallic molded case of the circuit breaker. An inner boundary of the first flow channel may be defined by an outer surface of the wall of the non-metallic partition structure.

Figure 2:
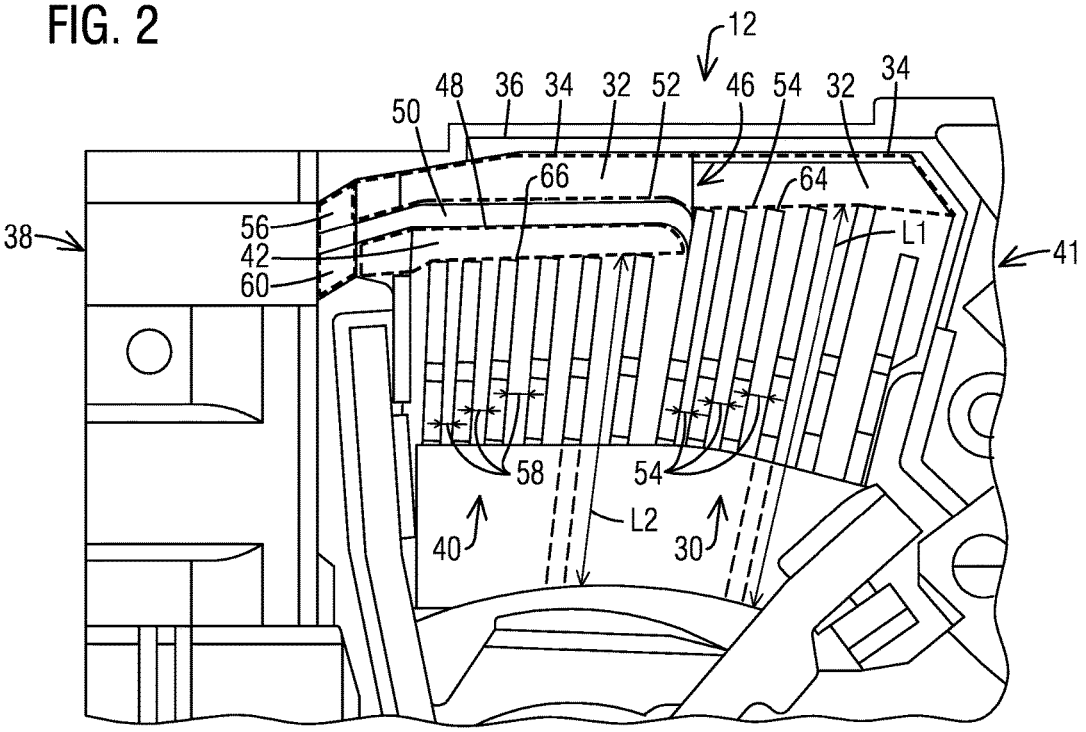
FIG. 2 is a cutaway view, zoomed-in to better appreciate certain structural and/or operational relationships regarding the disclosed electric arc extinguishing apparatus illustrated in FIG. 1, such as respective gas flow channels in the disclosed electric arc extinguishing apparatus.
Figure 3:
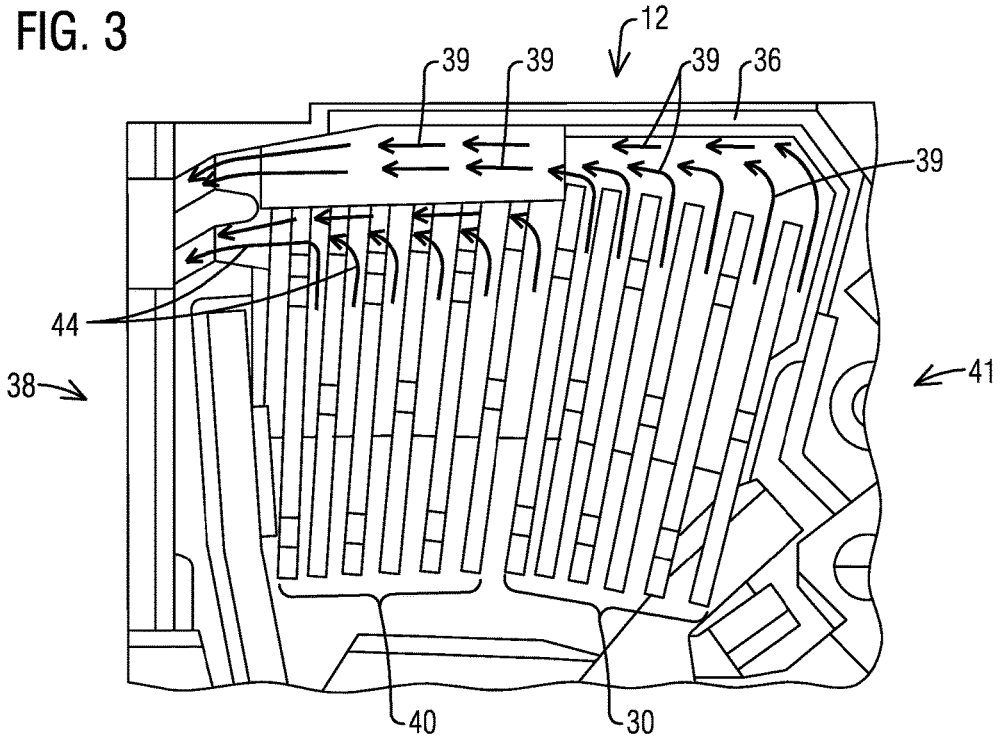

FIG. 3 schematically illustrates an exemplary gas flow through the flow channels shown in FIG. 2.

Figure 1:
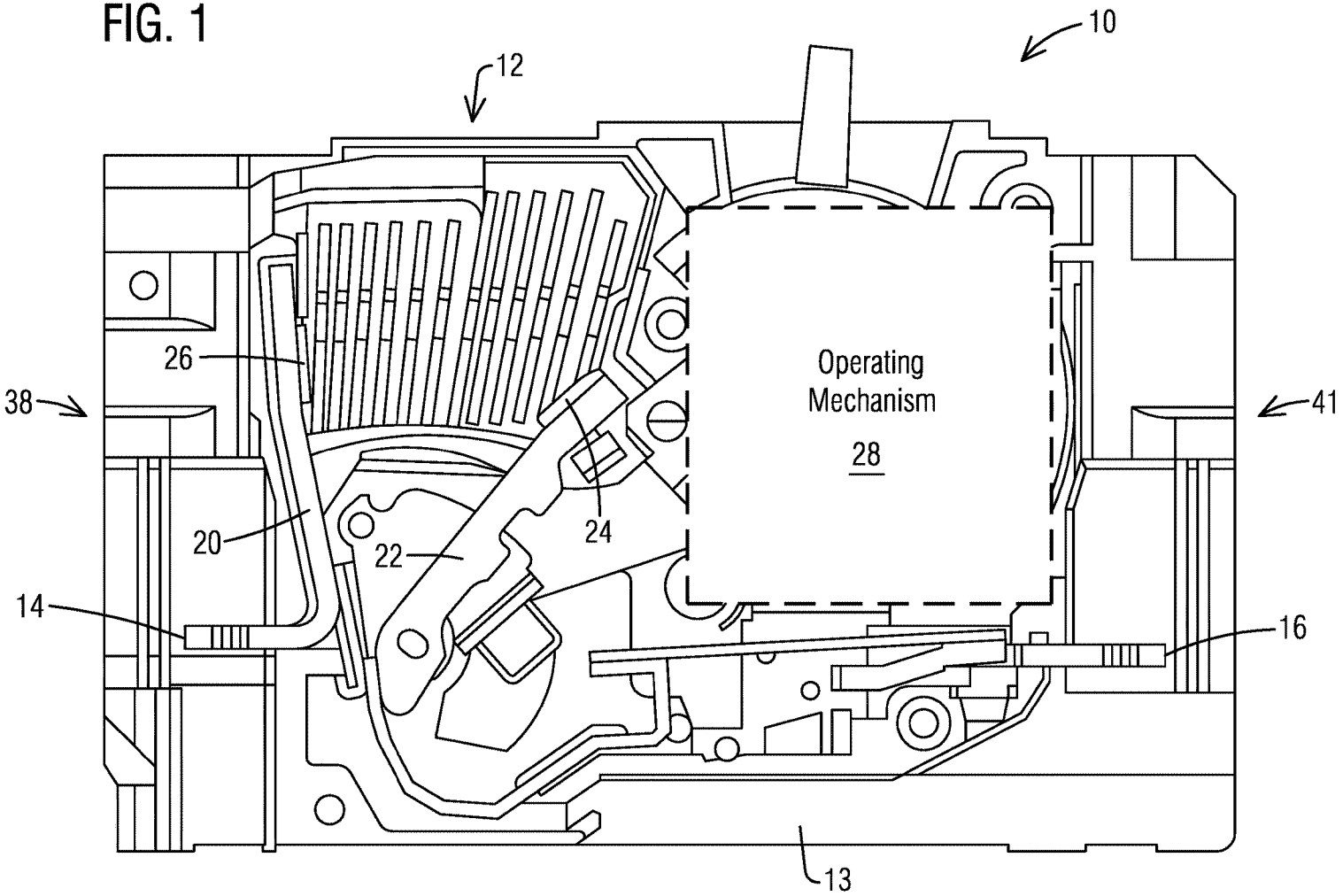
FIG. 1 is a cutaway view of a non-limiting embodiment of a molded case circuit breaker illustrating a disclosed electric arc extinguishing apparatus and a stationary contact and a movable contact of one pole of the circuit breaker, such as without limitation, the center pole (e.g., B-phase) of a three-phase circuit breaker.
Figure 4:
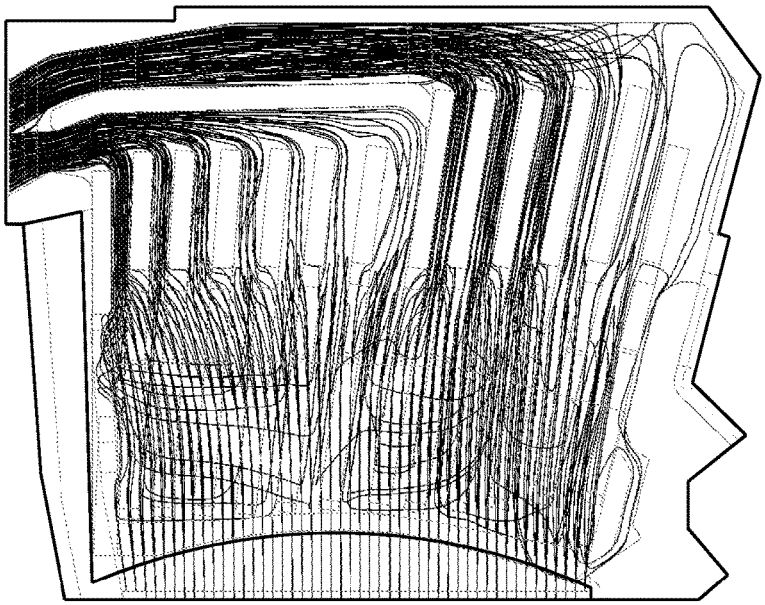

FIG. 4 is a gas flow simulation regarding the disclosed electric arc extinguishing apparatus illustrated in FIGS. 1 through 3.

Figure 5:
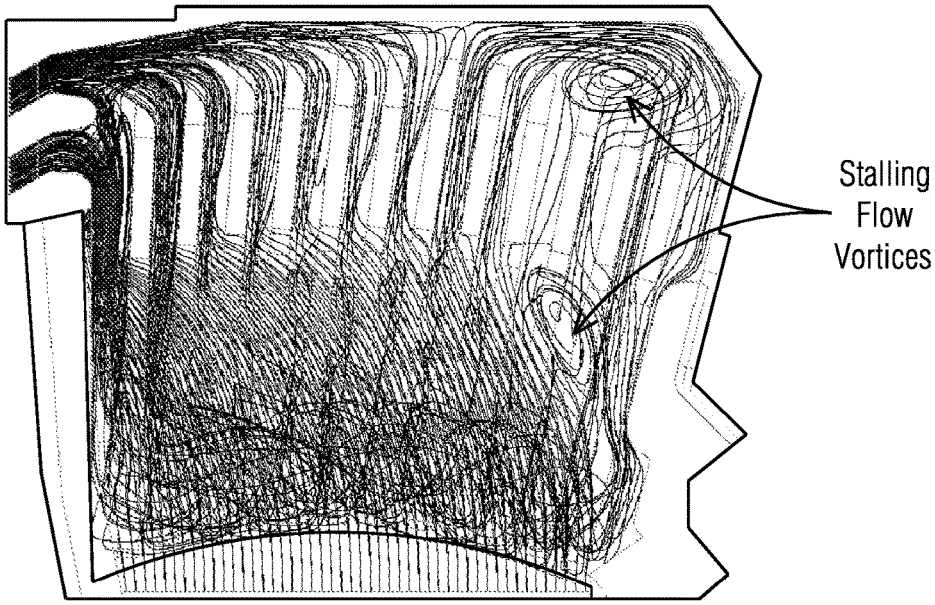
FIG. 5 PRIOR ART

FIG. 5 is a gas flow simulation regarding a prior art electric arc extinguishing apparatus.

Figure 6:
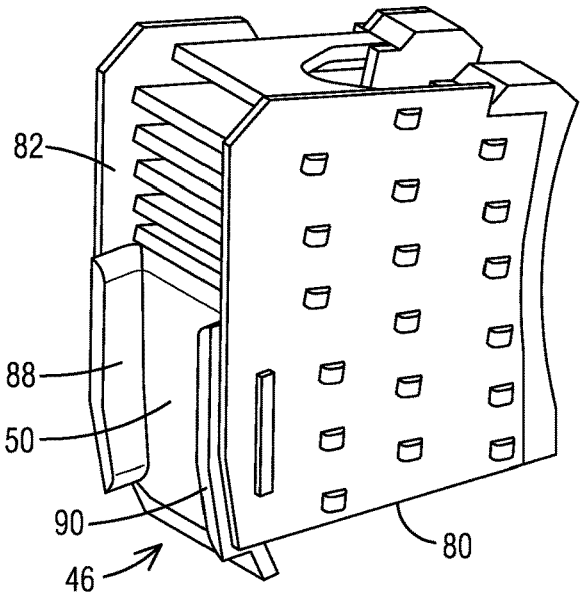

FIG. 6 is an isometric view of a non-limiting embodiment of an assembly of components regarding a disclosed electric arc extinguishing apparatus.

Figure 7:
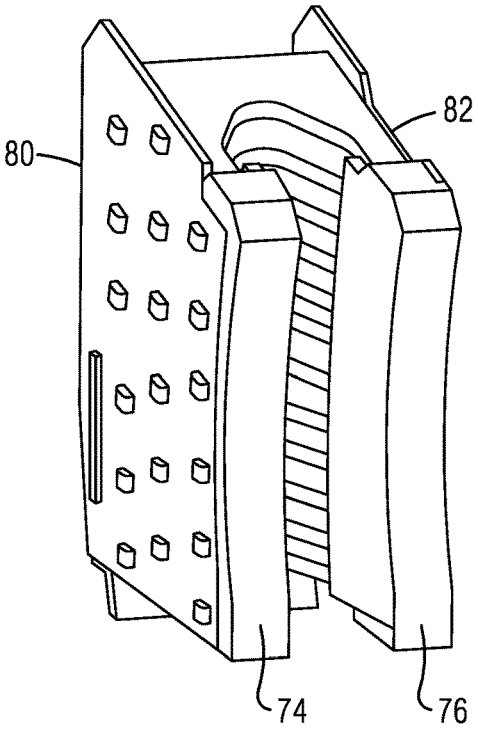

FIG. 7 is an isometric view of the assembly shown in FIG. 6.

Figure 8:
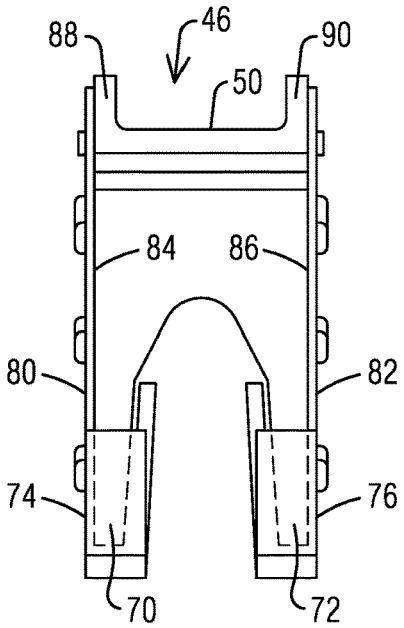

FIG. 8 is an end view of the assembly shown in FIGS. 6 and 7.

Figure 9:
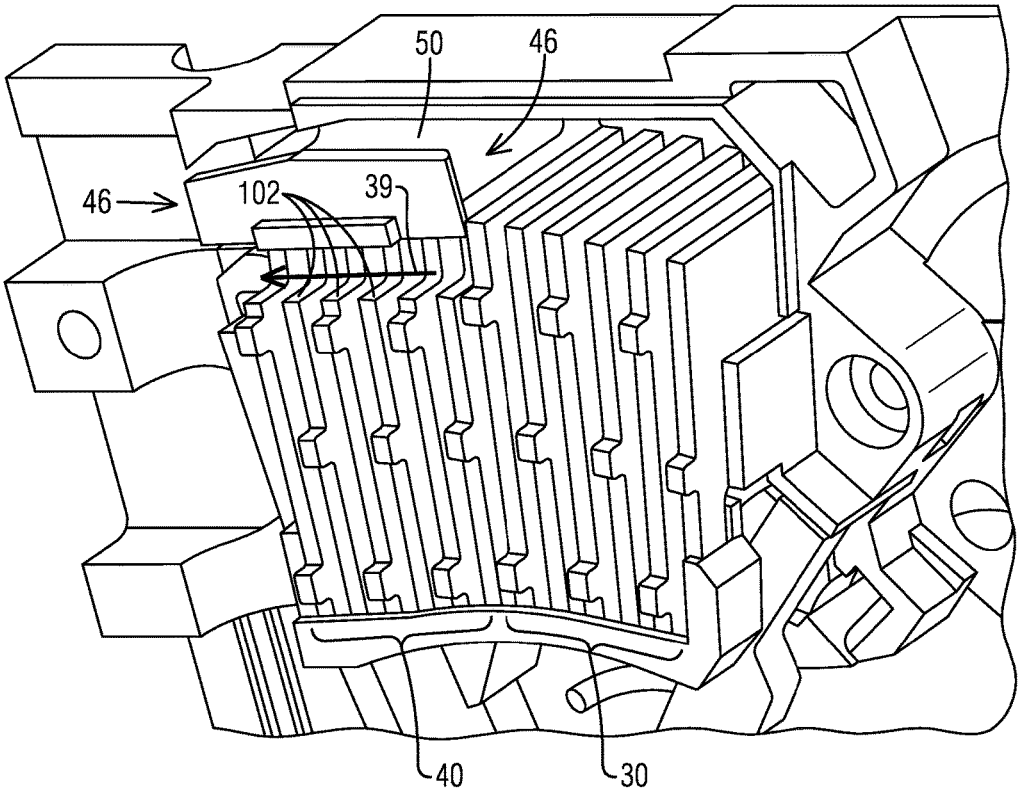

FIG. 9 is an isometric, cutaway view illustrating certain non-limiting structural features of arc splitter plates that may be used in a disclosed electric arc extinguishing apparatus.

FIGS. 10-13 are simplified schematic representations of non-limiting alternative embodiments of further disclosed electric arc extinguishing apparatuses.

DETAILED DESCRIPTION

Various interrelated issues have been recognized in connection with prior art circuit breaker designs involving molded case circuit breakers containing an electric arc extinguishing apparatus including metallic arc splitter plates (e.g., an arc stack of arc splitter plates, or simply "an arc stack"). In at least some of these prior art designs, the arc splitter plates may be arranged generally perpendicular to a wall of a casing of the molded case circuit breaker. During an electric arcing event, hot-temperature gases—resulting from the electric arc—flow through air gaps or spaces between the arc splitter plates toward a flow channel, where the hot gases strike the wall of the casing. This forces the gases to change direction and continue in the flow channel, which may be disposed generally at a right angle relative to the respective longitudinal axes of the arc splitter plates.

A gas exhaust outlet may be disposed at a given end of the flow channel (e.g., a load side of the circuit breaker) from which the flow of gases exits the circuit breaker. An issue with this prior art arrangement is that at the other end of the flow channel (e.g., a line side of the circuit breaker), opposite from the given end where the exhaust outlet is disposed, the flow of gases tends to stall, and, consequently at this other end of the flow channel, the velocity of the gas flow through the air gaps between the arc splitter plates may be substantially reduced. That is, the overall gas flow between the arc splitter plates in the arc stack becomes relatively non-uniform, as can be appreciated in the gas flow simulation shown in FIG. 5.

Because of the non-uniform gas flow, some of the arc splitter plates may be exposed to a relatively high velocity flow of gases, while others of the arc splitter plates may be exposed to a relatively low velocity flow of gases. Consequently, several of the arc splitter plates located at or near this other end of the flow gas channel may not be effectively used for extinguishing the electrical arc. This issue can detrimentally lower the arc voltage performance of the arc splitter plates resulting in suboptimal arc interruption performance.

Additionally, when the gas flow is not uniform more heat is absorbed (by way of convective heat transfer) by arc splitter plates in locations of high flow velocity, and less heat is absorbed by arc splitter plates in locations of low flow velocity. That is, arc splitter plates located in areas where there is high velocity gas flow increase in temperature relatively quickly compared to arc splitter plates located in areas subject to low velocity gas flow. But, as would be appreciated by those skilled in the art, the rate of heat transfer depends on temperature difference between the plate and the gas, and this difference becomes smaller as the plates become progressively hotter. This means that arc splitter plates at locations of relatively high velocity lose their ability to cool the hot gas more quickly, while arc splitter plates at locations of relatively low velocity are not effectively participating in cooling the arc. For maximum energy absorption, it is desirable that all plates cool the gas at approximately the same rate; otherwise, the arrangement of arc splitter plates is inefficient.

It be further appreciated that when some arc splitter plates heat up relatively more quickly than others, at least certain portions of these arc splitter plates may reach the melting point of the respective constituent metal or alloy of these arc splitter plates, such as may occur in portions of the arc splitter plates located closest to the arc or arc source. This can eventually, cause loss of mass in these arc splitter plates, which eventually can reduce the size of the surface area available for convective heat transfer. Even if the circuit breaker successfully interrupts a short circuit, its ability to reliably interrupt subsequent short circuits may be compromised.

To avoid melting of some of the arc splitter plates, it is desirable that the cooling rate be substantially uniform over all the arc splitter plates so that a maximum amount of energy is absorbed prior to reaching the melting point at any given location. Yet another issue of melting of certain arc splitter plates is that this may cause molten beads of metal to be blown away through the flow channel. The metal beads are undesirable for several reasons including formation of metal bead deposits in the air gaps between neighboring pairs of arc splitter plates that could potentially electrically short at least some of the arc splitter plates, and the arc voltage contribution associated with such arc splitter plates would be lost. Therefore, at least in view in the foregoing considerations, it is desirable to avoid or at least reduce the possibility of melting of any arc splitter plates. As noted above, achieving a relatively uniform gas flow between the arc splitter plates would be conducive to avoiding or at least reducing the possibility of melting of arc splitter plates.

At least in view of recognition of the foregoing issues, disclosed embodiments propose an innovative electric arc extinguishing apparatus fbr a molded case circuit breaker effective to provide a reliable and cost-effective technical solution to solve at least the issues mentioned above. Without limitation, disclosed embodiments make use of flow channels arranged to eliminate gas flow stalling and achieve gas flow velocity that is relatively more uniform throughout the arc stack compared with gas flow velocity achieved in prior art designs. Without limitation, compare the gas flow simulation results of a disclosed electric arc extinguishing apparatus shown in FIG. 4 with the prior art simulation results previously alluded to in the context of FIG. 5.

Without limitation, disclosed electric arc extinguishing apparatuses are relatively more efficient and capable of removing more heat from the hot gas flow since every arc splitter plate that forms the arc stack contributes to the cooling of the gas flow. Additionally, the electric arc is efficiently blown and distributed into each of the arc splitter plate gaps, resulting in higher arc voltage and improved arc extinguishing performance. It is believed that a circuit breaker equipped with the disclosed electric arc extinguishing apparatus will interrupt the electric arc relatively more quickly and with less let-through current than a circuit breaker equipped with a prior art electric arc extinguishing apparatus. Because disclosed arrangements of arc splitter plates are configured to more uniformly absorb heat throughout the arc stack, the arc stack can absorb more energy and thus avoid or substantially reduce the possibility of melting any of the arc splitter plates, which otherwise would degrade reliable performance of the arc stack. Therefore, the circuit breaker will reliably perform when subject to subsequent electric arc events.

In the following detailed description, various specific details are set forth in order to provide a thorough understanding of such embodiments. However, those skilled in the art will understand that disclosed embodiments may be practiced without these specific details that the aspects of the present invention are not limited to the disclosed embodiments, and that aspects of the present invention may be practiced in a variety of alternative embodiments, in other instances, methods, procedures, and components, which would be well-understood by one skilled in the art have not been described in detail to avoid unnecessary and burdensome explanation.

Furthermore, various operations may be described as multiple discrete steps performed in a manner that is helpful for understanding embodiments of the present invention. However, the order of description should not be construed as to imply that these operations need be performed in the order they are presented, nor that, they are even order dependent, unless otherwise indicated. Moreover, repeated usage of the phrase "in one embodiment" does not necessarily refer to the same embodiment, although it may. It is noted that disclosed embodiments need not be construed as mutually exclusive embodiments, since aspects of such disclosed embodiments may be appropriately combined by one skilled in the art depending on the needs of a given application.

In one non-limiting embodiment; a disclosed electric arc extinguishing apparatus may comprise a unitized electric arc extinguishing apparatus. The term "unitized" in the context of this application, unless otherwise stated, refers to a structure which is formed as a single piece (e.g., monolithic construction), such as without limitation, 3D Printing/Additive Manufacturing (AM) technologies, where the unitized structure, singly or in combination with other unitized structures, can form a component of the electric arc extinguishing apparatus; or an entire electric arc extinguishing apparatus including such components.

FIG. 1 is a cutaway view of a molded case circuit breaker 10 illustrating a non-limiting embodiment of a disclosed electric arc extinguishing apparatus 12. Molded case circuit breaker 10 includes a molded case 13, which typically is composed of a non-metallic, electrically-insulative material that can be molded, without limitation, by way of injection molding or any other suitable manufacturing technique, such as an AM technique.

As would be appreciated by one skilled in the art, molded case circuit breaker 10 typically includes a first terminal 14, such as a load terminal, and a second terminal 16, such as a line terminal. First and second terminals 14, 16 are respectively coupled to stationary and movable contact arms 20, 22. Contact arm 22 may be a movable contact arm that supports a movable contact 24, and contact arm 20 may be a stationary contact arm that supports a stationary contact 26. In operation, electric current flows between first and second terminals 14, 16 through contact arms 20, 22 and contacts 24, 26 when circuit breaker 10 is placed as part of an electrical circuit to protect an electric load (not shown) connected to load terminal 14. Contacts 24, 26 are typically composed of electrically conducting metal, such as without limitation, a silver-based composite including one or more of tungsten, tungsten-carbide, graphite, or tin-oxide, or other metals. In certain applications, copper or copper-alloy contacts may be implemented. Copper might be plated with tin, silver or other metals.

In FIG. 1, movable contact arm 22 is shown in an electrically-open condition, such as may occur after movable contact arm 22 has been actuated by an operating mechanism (schematically represented by block 28), in response to, for example, an overcurrent condition of a predetermined magnitude and duration. Since basic details of circuit breaker operation would be readily understood by one skilled in the art, the preceding description has been simplified to spare the reader from burdensome and pedantic details. Without limitation, in certain embodiments, operating mechanism 28 may be located just in the center pole (e.g., B-phase) of a three-phase circuit breaker. It will be appreciated that disclosed embodiments may be tailored to mono-phase or other poly-phase circuit breaker applications.

FIG. 2 is a cutaway view that zooms-in on electric arc extinguishing apparatus 12 to better appreciate certain structural and/or operational relationships regarding electric arc extinguishing apparatus 12. In one non-limiting embodiment, a first set of arc splitter plates 30 may be arranged to direct into a first flow channel 32 a flow of gases formed during an electric arcing event. Without limitation, an outer boundary 34 of first flow channel 32 may be defined by a wall 36 (e.g., a front wall) of casing 13 of the molded case circuit breaker. Wall 36 may be disposed to redirect at least one portion of the flow of gases (schematically represented by arrows 39 in FIG. 3) directed by first set of arc splitter plates 30 toward a first side 38 (e.g., a load side) of the molded case circuit breaker. Without limitation, first side 38 may be opposite a second side (e.g., line side 41) of the molded case circuit breaker.

As further appreciated in FIG. 2, a second set of arc splitter plates 40 may be arranged to direct into a second flow channel 42 a further flow of gases (schematically represented by arrows 44 in FIG. 3) formed during the electric arcing event. A non-metallic partition structure, such as without limitation a baffle 46, may be arranged to establish flow channel separation between first flow channel 32 and second flow channel 42. Without limitation, a boundary 48 of second flow channel 42 may be defined by an inner surface of a wall 50 of the baffle 46. The inner surface of wall 50 of baffle 46 may be arranged to redirect the further flow of gases directed by the second set of arc splitter plates 40 toward first side or load side 38 of the molded case circuit breaker 10. In one non-limiting embodiment, an inner boundary 52 of first flow channel may be defined by an outer surface of the wall 50 of baffle 46.

In one non-limiting embodiment, the first set of arc splitter plates 30 may comprise a parallel arrangement of arc splitter plates configured to define a gap 54 between one another, where the width of each gap between adjacent pairs of arc splitter plates of the first set of arc splitter plates 30 decreases in relation to the position (e.g., proximity) of each of the gaps 54 with respect to an outlet 56 of first flow channel 32 disposed by the first side 38 of the molded case circuit breaker. That is, the width of a gap relatively closer to outlet 56 would be narrower compared to the width of a gap father away from to outlet 56.

Similarly, the second set of arc splitter plates 40 may comprise a parallel arrangement of arc splitter plates configured to define a gap 58 between one another, where a respective width of each gap between adjacent pairs of arc splitter plates of the second set of arc splitter plates 40 decreases ire relation to the position (e.g., proximity) of each of the gaps 58 with respect to an outlet 60 of second flow channel 42 that also may be disposed by the first side 38 of the molded case circuit breaker. That is, the width of a gap relatively closer to outlet 60 would be narrower compared to the width of a gap father away from outlet 60.

As can be appreciated in FIGS. 2 and 3 the first set of arc splitter plates 30 and the second set of arc splitter plates 40 may comprise a sequential arrangement of spaced apart arc splitter plates that may be disposed, without limitation, between first and second sides 38, 41 of the molded case circuit breaker.

The foregoing feature (varying gap width between the arc splitter plates, as described above) is effective for further optimization of gas flow through the respective flow channels. For the sake of conceptual understanding, let us presume that all the gaps had the same width, then a gap located closest to a respective gas outlet would have the greatest flow velocity. This is because gaps farther away from the outlet would experience a greater pressure drop. Specifically, the arc gap in the first set of arc splitter plates 30 closest to outlet 56 of first flow channel 32, and the arc gap in the second set of arc splitter plates 40 closest to outlet 60 of second flow channel 42 would each have the respective greatest velocities compared to gas flow velocity in other gaps of the first and the second set of arc splitter plate 30, 40. Thus, to make the respective gas flow relatively more uniform, the gap width may be varied as described above.

Without limitation, this feature is conducive to reduce variation in flow velocity among the arc splitter plate gaps. It should be appreciated, that in practical embodiments, the goal is not necessarily to achieve perfectly uniform velocity for the respective gas flows. This might require the smallest gaps to be excessively small, and in this case small molten beads might electrically short the plates together. Therefore, in practical embodiments, appropriate compromise should be used for equalizing the flow velocity via gap width variation versus ensuring sufficient electrical isolation between the arc splitter plates.

In one non-limiting embodiment, the first set of arc splitter plates 30 may comprise arc splitter plates comprising a first longitudinal length L1, and the second set of arc splitter plates 40 may comprise arc splitter plates comprising a second longitudinal length L2, where the first length and the second length comprise different lengths relative to one another.

Without limitation, the first longitudinal length L1 of the first set of arc splitter plates 30 may be chosen to define a spacing between outer boundary 34 of first flow channel 32 and respective exit flow ends 64 of the first set of arc splitter plates 30. The second longitudinal length L2 of the second set of arc splitter plates 40 may be chosen to define a spacing between boundary 48 of second flow channel 42 and respective exit flow ends 66 of the second set of arc splitter plates 40. It will be appreciated that disclosed embodiments are not necessarily limited to arc splitter plates having different longitudinal lengths. Without limitation, this approach is one convenient and practical way to make room for two separate gas flow channels, which are separated by baffle 46, such as within a limited available space in a given circuit breaker design. Accordingly, it should be appreciated that there may be applications where arc splitter plates having different longitudinal lengths may not be involved to implement a disclosed electric arc extinguishing apparatus.

In one non-limiting embodiment, the first and the second set of arc splitter plates 30, 40, each comprises a respective pair of legs 70, 72 (FIG. 8) and a respective pair of insulating end caps 74, 76 respectively mounted onto the respective pair of legs 70, 72 of the first and the second set of arc splitter plates.

Although disclosed embodiments are not necessarily contingent on use of end caps, it will be appreciated that insulating end caps 74, 76 can provide certain benefits. First, end caps 74, 76 can prevent the electric arc from discharging directly from the contacts 24 26 to the respective legs 70, 72 of the arc splitter plates. This may be undesirable because otherwise electromagnetic arc force would be reduced, and the electric arc would have less force to appropriately propagate into the relative larger surface area of the arc splitter plates located above the legs of the arc splitter plates. Also, this may be undesirable because the nearest plate to movable contact 24 may not be the outermost plate at the end of the stack. Rather, the arc may initially discharge onto some intermediate arc splitter plate, such as the 3rd or 4th plate from the end of the stack, which would cause a substantial reduction in arc voltage and reduced arc extinguishing ability. Second, without limitation, end caps 74, 76 may comprise an appropriate ablative material conducive to outgassing due to heat generated by the arc. That is, end caps 74, 76 would ablate under exposure to the arc, giving off incremental quantities of gas, which would contribute to cooling, the arc and facilitate directing the arc into the arc splitter plates.

In one non-limiting embodiment, a first insulating side plate 80 (FIG. 8) is disposed in a spaced relationship with a second insulating side plate 82, and respective mutually opposed longitudinal edges 84, 86 of the first and the second set of arc splitter plates may be disposed between the first and second insulating side plates 80, 82. In one non-limiting embodiment, wall 50 of baffle 46 is interposed between first and second insulating side plates 80, 82 so that the inner surface of the wall of the baffle faces the exit flow ends of the second set of arc splitter plates 40.

In one non-limiting embodiment, baffle 46 comprises a pair of mutually opposed support ribs 88, 90 extending away from the outer surface of wall 50 of baffle 46. The pair of mutually opposed support ribs 88, 90 may respectively engage corresponding inner surfaces of the first and second insulating side plates 80, 82.

FIG. 9 is an isometric, cutaway view illustrating certain non-limiting structural features of arc splitter plates that may be used in a disclosed electric arc extinguishing apparatus. Without limitation, the second set of arc splitter plates 40 may comprise respective notches 102 that in part define the second flow channel 42 (FIG. 2), where the further flow of gas flow (schematically represented by arrow 39) passes.

FIGS. 10-13 are simplified schematic representations of non-limiting alternative embodiments of further disclosed electric arc extinguishing apparatuses. FIG. 10 illustrates an embodiment 110 of an electric arc extinguishing apparatus including first and second sets of arc splitter plates 30 and 40 arranged as described in the context of FIG. 2, and therefore such arrangement and operation will not be repeated here. Differently, in this embodiment an elongated exit conduit 112 may be configured to route the respective gas flows 39 and 44 respectively directed by the first and the second gas flow channels 32 and 42 to a desired exit location of the circuit breaker. That is, elongated exit conduit 112 may be tailored to alter gas flow direction of respective gas flows 39 and 44, such as based on the needs of a given circuit breaker application.

FIG. 11 illustrates an embodiment 120 of an electric arc extinguishing apparatus including first and second sets of arc splitter plates 30 and 40 arranged as described in the context of FIG. 2, and therefore such arrangement and operation will not be repeated here. Differently, in this embodiment a third set of arc splitter plates 122 may be arranged to direct into a third flow channel 124 another flow of gases (schematically represented by arrow 126) formed during the electric arcing event. Without limitation, a further baffle 128 may be arranged to establish flow channel separation between third first flow channel 124 with respect to the first and second flow channels 32, 42. Further baffle 128 may be arranged to redirect the gas flow 126 directed by the third set of arc splitter plates 122 toward first side 38 of the molded case circuit breaker.

FIG. 12 illustrates an embodiment 130 including first and second sets of arc splitter plates 30 and 40 arranged as described in the context of FIG. 2, and therefore such arrangement and operation will not be repeated here. As noted above, a first outlet 132 may be disposed by first side 38 of the circuit breaker to provide exit to gas flow 39 directed by the first set of arc splitter plates 30 to first flow channel 32. Differently, a second outlet 134 may be disposed by second side 41 of the circuit breaker to provide exit to another portion of the flow of gases (schematically represented by arrow 136) directed by the first set of arc splitter plates 30.

FIG. 13 illustrates an embodiment 130 including first and second sets of arc splitter plates 30 and 40 arranged as described in the context of FIG. 12 and therefore such arrangement and operation will not be repeated here. Differently, in this embodiment a third set of arc splitter plates 142 may be arranged to direct into a third flow channel 144 another flow of gases (schematically represented by arrow 146) formed during the electric arcing event. In this embodiment, an outlet 148 may be disposed by second side 41 of the circuit breaker to provide exit to the gas flow 146 directed by the third set of arc splitter plates 142.

From the foregoing disclosure, it should be appreciated that disclosed embodiments of electric arc extinguishing apparatus can offer substantial design versatility to accommodate a wide range of needs that may arise in different circuit breaker applications.

While embodiments of the present disclosure have been disclosed in exemplary forms, it will be apparent to those skilled in the art that many modifications, additions, and deletions can be made therein without departing from the scope of the invention and its equivalents, as set forth in the following claims.

What is claimed is:

1. An electric arc extinguishing apparatus for a molded case circuit breaker comprising:

a first set of arc splitter plates arranged to direct into a first flow channel, a flow of gases formed during an electric arcing event, wherein an outer boundary of the first flow channel is defined by a wall of a casing of the molded case circuit breaker, the wall disposed to redirect at least one portion of the flow of gases directed by the first set of arc splitter plates toward a first side of the molded case circuit breaker;

a second set of arc splitter plates arranged to direct into a second flow channel, a further flow of gases formed during the electric arcing event; and a baffle arranged to establish flow channel separation between the first flow channel and the second flow channel, wherein a boundary of the second flow channel is defined by an inner surface of a wall of the baffle, the inner surface of the wall of the baffle arranged to redirect the further flow of gases directed by the second set of arc splitter plates toward the first side of the molded case circuit breaker.

2. The electric arc extinguishing apparatus of claim 1, wherein an inner boundary of the first flow channel is defined by an outer surface of the wall of the baffle.

3. The electric arc extinguishing apparatus of claim 1, wherein the first set of arc splitter plates comprises a parallel arrangement of arc splitter plates configured to define a gap between one another, wherein a respective width of each respective gap between adjacent pairs of arc splitter plates of the first set of arc splitter plates decreases in relation to the position of each of the respective gaps with respect to an outlet of the first flow channel.

4. The electric arc extinguishing apparatus of claim 1, wherein the second set of arc splitter plates comprises a parallel arrangement of arc splitter plates configured to define a gap between one another, wherein a respective width of each respective gap between adjacent pairs of arc splitter plates of the second set of arc splitter plates decreases in relation to the position of each of the respective gaps with respect to an outlet of the second flow channel.

5. The electric arc extinguishing apparatus of claim 1, wherein the first set of arc splitter plates and the second set of arc splitter plates comprise a sequential arrangement of spaced apart arc splitter plates relative to one another.

6. The electric arc extinguishing apparatus of claim 1, wherein the first set of arc splitter plates comprise arc splitter plates comprising a first longitudinal length, and the second set of arc splitter plates comprise arc splitter plates comprising a second longitudinal length, wherein the first length and the second length comprise different lengths relative to one another.

7. The electric arc extinguishing apparatus of claim 6, wherein the first longitudinal length of the first set of arc splitter plates is chosen to define a spacing between the outer boundary of the first flow channel and respective exit flow ends of the first set of arc splitter plates, and further wherein the second longitudinal length of the second set of arc splitter plates is chosen to define a spacing between the boundary of the second flow channel and respective exit flow ends of the second set of arc splitter plates.

8. The electric arc extinguishing apparatus of claim 1, wherein the first and the second set of arc splitter plates each comprises a respective pair of legs, and a respective pair of insulating end caps respectively mounted onto the respective pair of legs of the first and the second set of arc splitter plates.

9. The electric arc extinguishing apparatus of claim 1, further comprising a first insulating side plate in a spaced relationship with a second insulating side plate, wherein respective mutually opposed longitudinal edges of the first and the second set of arc splitter plates are disposed between the first and second insulating side plates, and wherein the wall of the baffle is interposed between the first and second insulating side plates so that the inner surface of the wall of the baffle faces respective exit flow ends of the second set of arc splitter plates.

10. The electric arc extinguishing apparatus of claim 9, wherein the baffle comprises a pair of mutually opposed support ribs extending away from the outer surface of the wall of the baffle, the pair of mutually opposed support ribs respectively engaging corresponding inner surfaces of the first and second insulating side plates.

11. The electric arc extinguishing apparatus of claim 1, wherein the baffle comprises a unitized structure with the casing of the circuit breaker.

12. The electric arc extinguishing apparatus of claim 1, further comprising at least one of the following outlets fluidly coupled to the first flow channel: a first outlet disposed by the first side of the circuit breaker to provide exit to said at least one portion of the flow of gases directed by the first set of arc splitter plates, a second outlet disposed by a second side of the circuit breaker opposed to the first side of the circuit breaker to provide exit to another portion of the flow of gases directed by the first set of arc splitter plates, or both the first outlet disposed by the first side of the circuit breaker and the second outlet disposed by a second side of the circuit breaker.

13. The electric arc extinguishing apparatus of claim 1, further comprising a third set of arc splitter plates arranged to direct into a third flow channel another flow of gases formed during the electric arcing event, and a further baffle arranged to establish flow channel separation between the third first flow channel with respect to the first and second flow channels, the further baffle arranged to redirect the another flow of gases directed by the third set of arc splitter plates toward the first side of the molded case circuit breaker, or toward a second side of the molded case circuit breaker opposed to the first side of the molded case circuit breaker.

14. The electric arc extinguishing apparatus of claim 13, wherein the first set of arc splitter plates, the second set of arc splitter plates and the third set of arc splitter plates comprise a sequential arrangement of spaced apart arc splitter plates.

15. A molded case circuit breaker comprising:

a non-metallic molded case;

first and second terminals;

first and second contacts respectively coupled to the first and second terminals;

an operating mechanism contained within said non-metallic molded case and coupled to a respective one of the first and second contacts to cause the respective contact to disengage the other of the contacts in response to an overcurrent condition in a protected electric load;

an arc stack comprising a first set of arc splitter plates and a second set of arc splitter plates forming a sequential arrangement of spaced apart arc splitter plates to cool and deionize an electric arc formed between said contacts when said contacts are separated in response to the overcurrent condition, wherein the first set of arc splitter plates is arranged to direct into a first flow channel, a flow of gases resulting from occurrence of the electric arc, wherein an outer boundary of the first flow channel is defined by a wall of the non-metallic molded case of the circuit breaker, the wall disposed to redirect at least one portion of the flow of gases directed by the first set of arc splitter plates toward a first side of the non-metallic molded case of the circuit breaker;

a second set of arc splitter plates arranged to direct into a second flow channel, a further flow of gases resulting from the occurrence of the electric arc; and a non-metallic partition structure arranged to establish flow channel separation between the first flow channel and the second flow channel, wherein a boundary of the second flow channel is defined by an inner surface of a wall of the non-metallic partition structure, the inner surface of the wall of the non-metallic partition structure arranged to redirect the further flow of gases directed by the second set of arc splitter plates toward the first side of the non-metallic molded case of the circuit breaker, wherein an inner boundary of the first flow channel is defined by an outer surface of the wall of the non-metallic partition structure.

16. The electric arc extinguishing apparatus of claim 15, wherein the first set of arc splitter plates comprises a parallel arrangement of arc splitter plates configured to define a gap between one another, wherein a respective width of each respective gap between adjacent pairs of arc splitter plates of the first set of arc splitter plates decreases in relation to the position of each of the respective gaps with respect to an outlet of the first flow channel disposed by the first side of the molded case circuit breaker.

17. The electric arc extinguishing apparatus of claim 16, wherein the second set of arc splitter plates comprises a parallel arrangement of arc splitter plates configured to define a gap between one another, wherein a respective width of each respective gap between adjacent pairs of arc splitter plates of the second set of arc splitter plates decreases in relation to the position of each the respective gaps with respect to an outlet of the second flow channel disposed by the first side of the molded case circuit breaker.

18. The electric arc extinguishing apparatus of claim 15, wherein the first set of arc splitter plates comprise arc splitter plates comprising a first longitudinal length, and the second set of arc splitter plates comprise arc splitter plates comprising a second longitudinal length, wherein the first length and the second length comprise respective different lengths relative to one another, wherein the first longitudinal length of the first set of arc splitter plates is chosen to define a spacing between the outer boundary of the first flow channel and respective exit flow ends of the first set of arc splitter plates, and further wherein the second longitudinal length of the second set of arc splitter plates is chosen to define a spacing between the boundary of the second flow channel and respective exit flow ends of the second set of arc splitter plates.

19. The electric arc extinguishing apparatus of claim 18, wherein the first and the second set of arc splitter plates each comprises a respective pair of legs, and a respective pair of insulating end caps respectively mounted onto the respective pair of legs of the first and the second set of arc splitter plates.

20. The electric arc extinguishing apparatus of claim 15, further comprising a first insulating side plate in a spaced relationship with a second insulating side plate, wherein respective mutually opposed longitudinal edges of the first and the second set of arc splitter plates are disposed between the first and second insulating side plates, wherein the wall of the baffle is interposed between the first and second insulating side plates so that the inner surface of the wall of the baffle faces respective exit flow ends of the second set of arc splitter plates, and wherein the baffle comprises a pair of mutually opposed support ribs extending away from the outer surface of the wall of the baffle, the pair of mutually opposed support ribs respectively engaging corresponding inner surfaces of the first and second insulating side plates.

* * * * *